US005678121A

United States Patent [19]

Meetze, Jr. et al.

[11] Patent Number: 5,678,121

[45] Date of Patent: Oct. 14, 1997

[54] DOCUMENT PRODUCTION MACHINE HAVING AN ORIENTATION-INDEPENDENT CARTRIDGE DISCRIMINATING SYSTEM ASSEMBLY

[75] Inventors: Murray O. Meetze, Jr.; Binns C. Handy, both of Rochester, N.Y.

[73] Assignee: Xerox Corporation, Stamford, Conn.

[21] Appl. No.: 673,548

[22] Filed: Jul. 1, 1996

[51] Int. Cl.[6] ..... G03G 15/00

[52] U.S. Cl. ..... 399/12; 399/262

[58] Field of Search ..... 399/12, 107, 110, 399/111, 119, 222, 258, 262

[56] References Cited

U.S. PATENT DOCUMENTS

| | | | |
|---|---|---|---|
| 4,611,899 | 9/1986 | Kasamura et al. | 399/12 |
| 4,740,808 | 4/1988 | Kasamura et al. | 399/12 |
| 4,949,123 | 8/1990 | Takashima | 399/12 |
| 5,075,724 | 12/1991 | Wada et al. | 399/12 |
| 5,184,181 | 2/1993 | Kurando et al. . | |
| 5,392,102 | 2/1995 | Toyoizumi et al. | 399/262 X |
| 5,396,316 | 3/1995 | Smith . | |

*Primary Examiner*—Sandra L. Brase
*Attorney, Agent, or Firm*—Tallam I. Nguti

[57] ABSTRACT

In a hard copy document production machine using a plurality of different type cartridges containing different document production consumable materials, an orientation-independent cartridge type discriminating system assembly suitable for enabling non-burdensome orientation-independent loading of a correct cartridge into a cartridge opening in the machine, and for resiliently intercepting and preventing loading of an incorrect cartridge into the cartridge opening. The discriminating system assembly includes a resilient assembly mounted to a portion of the frame of the machine defining the cartridge opening, a first spring member, and a pivotable elongate member connected to the spring member for providing resilient cartridge contact with a cartridge being inserted. The elongate member has a displaceable portion, and a cartridge blocking portion spaced from the displaceable portion in a direction of cartridge insertion. The displaceable portion has a cartridge-type first specific distance measured from the cartridge blocking portion, and the cartridge blocking portion has a first position within the cartridge opening, and a second position adjacent the cartridge opening. The discriminating system assembly also includes a displacer device formed on a surface of a cartridge being inserted into the cartridge opening, and has a cartridge-type specific second distance measured from a lead edge of a cartridge of the type of cartridge being inserted. The cartridge-type specific second distance determines a correct cartridge when it is equal to the cartridge-type specific first distance, and the displacer device extends continuously and uniformly in a direction transverse to the direction of cartridge insertion, so as to enable non-burdensome, orientation-independent loading of a cartridge into the cartridge opening.

21 Claims, 8 Drawing Sheets

DOCUMENT PRODUCTION MACHINE HAVING AN ORIENTATION-INDEPENDENT CARTRIDGE DISCRIMINATING SYSTEM ASSEMBLY

BACKGROUND OF THE INVENTION

This invention relates generally to document production or reproduction machines such as copiers and printers, and more particularly to such a machine using a plurality of different cartridge type containers and having an orientation-independent cartridge discriminating system assembly.

Copy or document production and reproduction machines such as copiers and printers of various kinds am well known. Such machines are available in various model types and sizes, and utilize various and different types of consumable materials such as paper, staples, developer, and particularly marking material like ink or toner. It is also well known in more and more cases, to supply replacement quantities of each such consumable material in a customer replaceable container or cartridge. Some of such supplied containers and cartridges are often physically very similar, but are intended for significantly different applications or uses within the machine or between machines. Inadvertent misapplication or misuse is therefore often a risk that must be reduced.

For example, in an electrostatographic color document production or reproduction machine with multiple different color development units, customer replenishment toner cartridges may physically look alike, but they differ significantly in color, and there has always been a need to prevent inadvertent misloading of a particular toner cartridge into a wrong or different color toner development unit of the color machine.

Conventionally, as disclosed for example in U.S. Pat. No. 5,184,181 and U.S. Pat. No. 5,396,316, cartridge misloading prevention mechanisms can involve complex electronic code recognition devices, or orientation dependent key and keyway mechanisms, respectively. U.S. Pat. No. 5,184,181 for example diecloses a cartridge discriminating system that includes an electrical cartridge type indicating means for detecting the suitability of the type and position of a cartridge being installed in a machine. The cartridge is allowed to be installed only when an electrical signal from the cartridge type indication detecting means agrees with information from a reference indication means. U.S. Pat. No. 5,396,316 meanwhile discloses an example of a key and keyway mechanism for a user replaceable liquid toner cartridge. The cartridge has an integral pump and valve mechanisms including mechanical connectors that mate with the cartridge upon insertion into a machine. To prevent incorrect insertion, the cartridge includes a key member that must be aligned and mated with a slot or keyway.

Complex electronic code recognition devices such as that disclosed in U.S. Pat. No. 5,184,181, besides being relatively more expensive, are also more likely to fail as well as require specialized technical service. Conventional key and keyway mechanisms such as that disclosed in U.S. Pat. No. 5,396,316, on the other hand, are orientation dependent, usually requiring trial and error alignment efforts of features such as a key or tab with a slot on surfaces simultaneously being blocked by the very cartridge being aligned. In a significant number of cases, such alignment efforts are frustrating and burdensome, particularly where the cartridge is relatively heavy, or where potentially it can soil or contaminate the machine as in the case of some replacement toner cartridges.

There has therefore been a need for an effective but relatively inexpensive and less frustrating or burdensome cartridge discriminating system assembly or mechanism for customer replaceable cartridges in copy production or reproduction machines.

SUMMARY OF THE INVENTION

In accordance with the present invention, there is provided in a hard copy document production machine using a plurality of different type cartridges containing different document production consumable materials, an orientation-independent cartridge type discriminating system assembly. The orientation-independent cartridge type discriminating system assembly is suitable for enabling non-burdensome orientation-independent loading of a correct cartridge into a cartridge opening in the machine, and for intercepting and preventing loading of an incorrect cartridge into the cartridge opening. The discriminating system assembly includes a resilient assembly mounted to a defining portion of the frame of the machine which defines the cartridge opening. The resilient assembly includes a first spring member and a pivotable elongate member connected to the spring member for providing resilient cartridge contact upon cartridge insertion. The elongate member has a first and a second end, a displaceable portion, and a cartridge blocking portion located towards the first end and spaced from the displaceable portion in a direction of cartridge insertion. The displaceable portion has a cartridge-type first specific distance measured from the cartridge blocking portion, and the cartridge blocking portion has a first position within the cartridge opening, and a second position adjacent the cartridge opening. The discriminating system assembly also includes a displacer device formed on a surface of a cartridge being inserted into the cartridge opening. The displacer device has a cartridge-type specific second distance measured from a lead edge of a cartridge of the type of cartridge being inserted. The cartridge-type specific second distance determines a correct cartridge when it is equal to the cartridge-type specific first distance, and the displacer device extends continuously and uniformly in a direction transverse to the direction of cartridge insertion, so as to enable non-burdensome, orientation-independent loading of a cartridge into the cartridge opening.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 11:
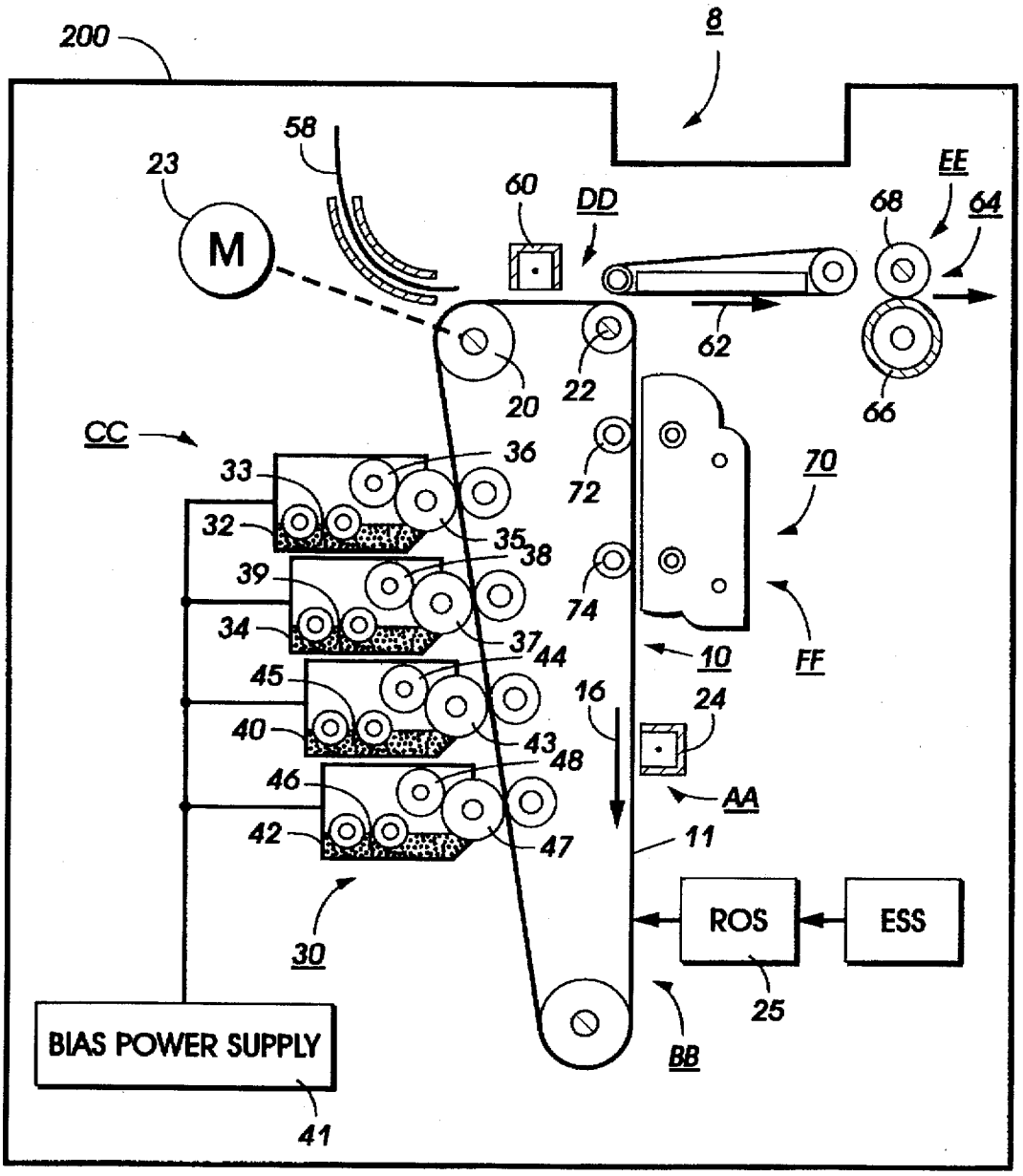
FIG. 11 is a schematic illustration of a hard copy document production machine incorporating the orientation-independent cartridge discriminating system assembly of the present invention.

Referring first to FIG. 11, an exemplary embodiment of a color electrostatographic printing or copying machine 8 having a machine frame 200 is shown suitable for use with the orientation-independent color toner cartridge discriminating assembly according to the present invention. Although the embodiment herein is directed to different color toner cartridges, it should be understood that the concepts and features of the present invention are equally applicable to cartridges or containers containing other types of copy production or reproduction consumables, such as different size staples or sheets, and different kinds of developer material, toners or inks.

As illustrated, the color reproduction machine 8 utilizes a charge retentive member in the form of the photoconductive belt 10 consisting of a photoconductive surface and an electrically conductive, light transmissive substrate mounted for movement pass charging station AA; an exposure station BB; developer stations CC including part of the orientation-independent assembly of the present invention (to be described in detail below); transfer station DD; fusing station EE; and a cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by continued reference to FIG. 11, initially successive portions of belt 10 pass through charging station AA. At charging station AA, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station BB. At exposure station BB, the uniformly charged photoreceptor or charge retentive surface 10 is imagewise exposed to a laser based input and/or output scanning device 25 which causes the charge retentive surface to be discharged in accordance with the output from the scanning device (for example, a two level Raster Output Scanner (ROS)).

The photoreceptor, which is initially charged to a uniformly high voltage level, undergoes dark decay to a lower voltage level. When exposed at the exposure station BB it is discharged to near zero or to ground potential in the image area for all color image separations.

At development station CC, a multi-unit development system, indicated generally by the reference numeral 30, advances development materials from a development housing into contact with the electrostatic latent images. The multi-unit development system 30 comprises first 42, second 40, third 34 and fourth 32 developer units. The first developer unit 42 comprises a housing containing a donor roll 47, a magnetic roller 48, and a first developer material containing a first color toner 46. The second developer unit 40 comprises a housing containing a donor roll 43, a magnetic roller 44, and a second developer material containing a second color toner 45. The third developer unit 34 comprises a housing containing a donor roll 37, a magnetic roller 38, and a third developer material containing a third color toner 39. The fourth developer unit 32 comprises a housing containing a donor roll 35, a magnetic roller 36, and a fourth developer material containing a fourth color toner 33. The magnetic rollers 36, 38, 44, and 48 each develop the toner or marking particles onto donor rolls 35, 37, 43 and 47, respectively. The donor rolls 35, 37, 43, and 47 then develop the toner onto the imaging surface 11 in accordance with any of the well known schemes, for example, the scheme involving multiple photoreceptor pass image formation and development as illustrated, or one of those involving photoreceptor single pass, or image on image formation. Regardless of the scheme used, it is preferred that development housings 32, 34, 40, 42, and any subsequent development housings be scavengeless so as not to disturb the image formed by the previous development unit. The four developer housings 42, 40, 34, and 32 contain different color toners 46, 45, 39, and 33 which are for example, black, cyan, magenta and yellow toners. Electrical biasing is accomplished via power supply 41, which is electrically connected to developer units 32, 34, 40 and 42.

In a multiple pass process or scheme, as illustrated, the process begins with an image area of the belt 10 passing through charging station AA, where the corona generating device 24 charges it to a relatively high and substantially uniform potential. The now charged image area then passes through exposure station BB where it is image-wise exposed by ROS device 25 to a light representation of a first color (say black) separation image, thus forming a first latent separation image of a multicolor image being reproduced.

The latent image carrying area then advances to the development station CC where it passes through the first development station 42 which deposits a first color of appropriately charged toner particles 45, preferably black, onto the latent image. The charged toner adheres to the image, thus resulting in development of the first separation image.

After passing through the first development station 42, the image area advances so as to return to the charging station AA to begin a second imaging cycle. The corona generating device 24 is used to overcharge the image area and its first toner image separation. The now recharged image area with its first toner or developed separation image is advanced to the exposure station BB, where the recharged image area is again exposed to a light representation of a second color separation image, thus forming a second latent color separation image. The image area with the second latent image and first toned or developed separation image is then moved passed the second development station 40 where the second color toner particles 45 of a second color, are deposited onto, thus developing, the second latent separation image in the image area.

Similarly, the imaging cycle is repeated for the third and fourth separation color images, as in the cases of the first and the second separation color images. The composite number of toner developed color separation images in the image area is thus increased by one each imaging cycle, and the number of cycles depends on the number of colors in the image being reproduced.

After the last or final color separation image has been developed, the image area with its composite color image thereon is then advanced to the transfer station DD where a copy sheet 58 is fed into image transfer contact therewith. The sheet 58 is appropriately charged by the transfer charging device 60 so as to assist transfer of the composite image from the surface 11 onto the sheet 58. After receiving the composite color toner image, the sheet 58 continues to move in the direction of arrow 62, to fusing station EE.

Fusing station EE includes a fuser assembly, indicated generally by the reference numeral 64, which heats and permanently affixes the transferred composite toner image to the sheets. Preferably, fuser assembly 64 includes a heated fuser roller 66 adapted to be pressure engaged with a back-up roller 68 with the toner image contacting the fuser roller 66.

After fusing, copy sheets 58 are directed to a catch tray, not shown, or to a finishing station for binding, stapling, collating, etc., or for removal from the machine by the operator. Alternatively, the sheet may be advanced to a duplex tray (not shown) from which it will be returned to the transfer station for receiving a second image on a second side of the sheet.

As shown, residual toner and debts remaining on photoreceptor belt 10 after each toner image is transferred to the sheet 58, may be removed at cleaning station FF with a brush or other type of cleaning system 70. The cleaning system is supported under the photoreceptive belt, for example, by two backers 72 and 74.

As is well known, toner or marking particle development of the latent images as described above, gradually depletes the quantity and concentration of each color of such particles being used from each development housing. Fresh toner or marking particles of the correct or matching color, which are usually supplied in customer replaceable containers or cartridges, must therefore be added or replenished as needed to each such housing, and at a rate depending on the rate of use of the particles of each color.

In replenishing the depleted toner particles, care however must be exercised in order to insure that the wrong color toner particles are not inadvertently replenished to a particular developer housing, and that inadvertent attempts to replenish with an incorrect or wrong toner color does not damage or contaminate the particular color toner in the housing. Importantly too, the loading even of the correct replenishment container or cartridge to a particular developer housing, should not be overly burdensome. This is so as not to limit the weight of replenishment toner particles that an operator can effectively handle and manipulate during such a loading process.

Figure 1:
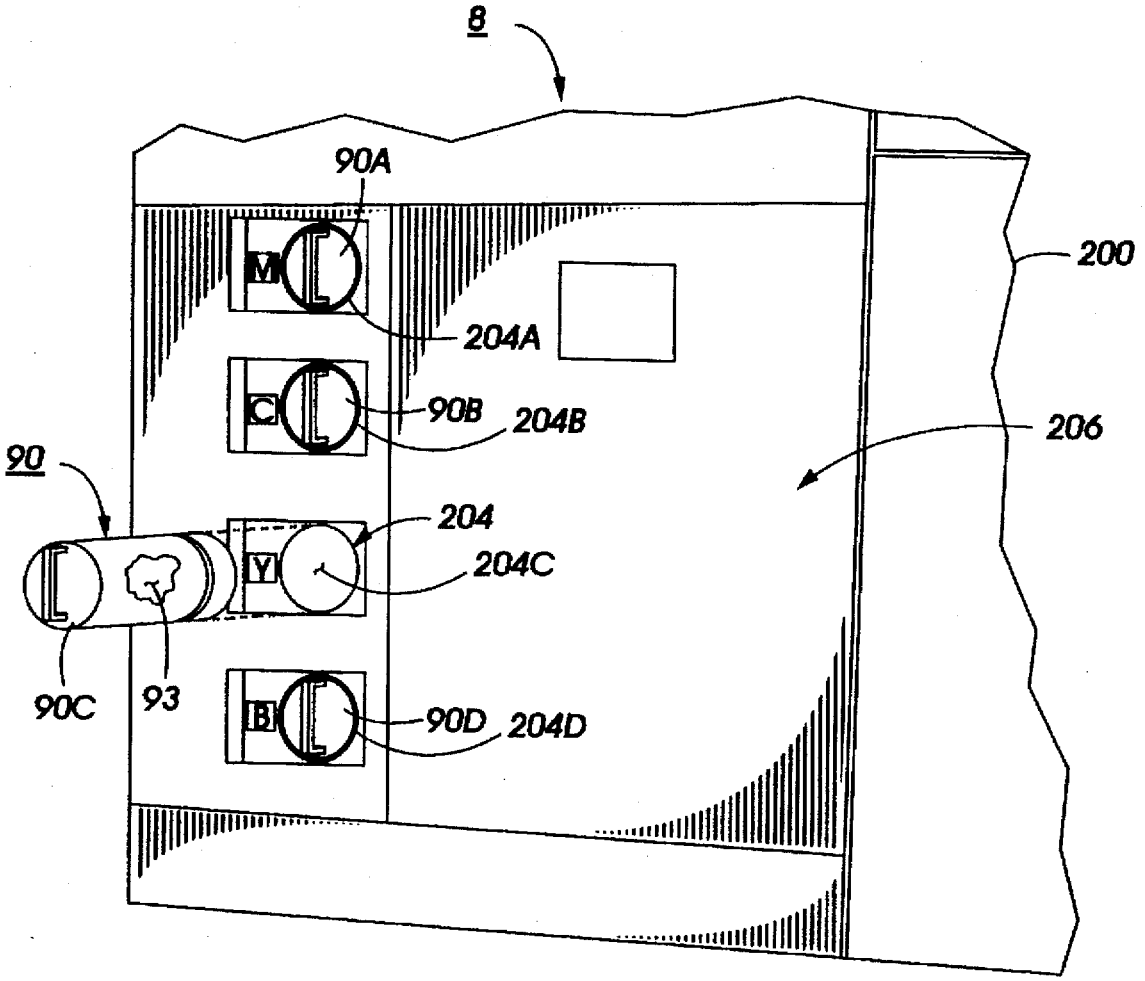
FIG. 1 is a partial front view illustration of an exemplary document production machine according to the present invention, showing a plurality of cartridge receiving openings and four different types of consumable material (toner) cartridges for removably loading therein.

Thus, in accordance with the present invention as shown in FIG. 1, each of the different colors of fresh or replenishment toner or marking particles is provided in a customer replaceable container or cartridge 90. A plurality (4) of different types of customer replaceable containers or cartridges formed for the present invention with cartridge type specific geometric features is illustrated as 90A, 90B, 90C, and 90D (90A–90D). Each toner or marking particle container type 90A–90D includes a chamber 93 for storing a supply of toner or marking particles of a particular color, such as black, cyan, magenta or yellow, and is correctly insertable into a cartridge opening 204. Each cartridge opening 204 when equipped with subassemblies of the cartridge specific discriminating system of the present invention, is shown appropriately as 204A, 204B, 204C or 204D.

Figure 2:
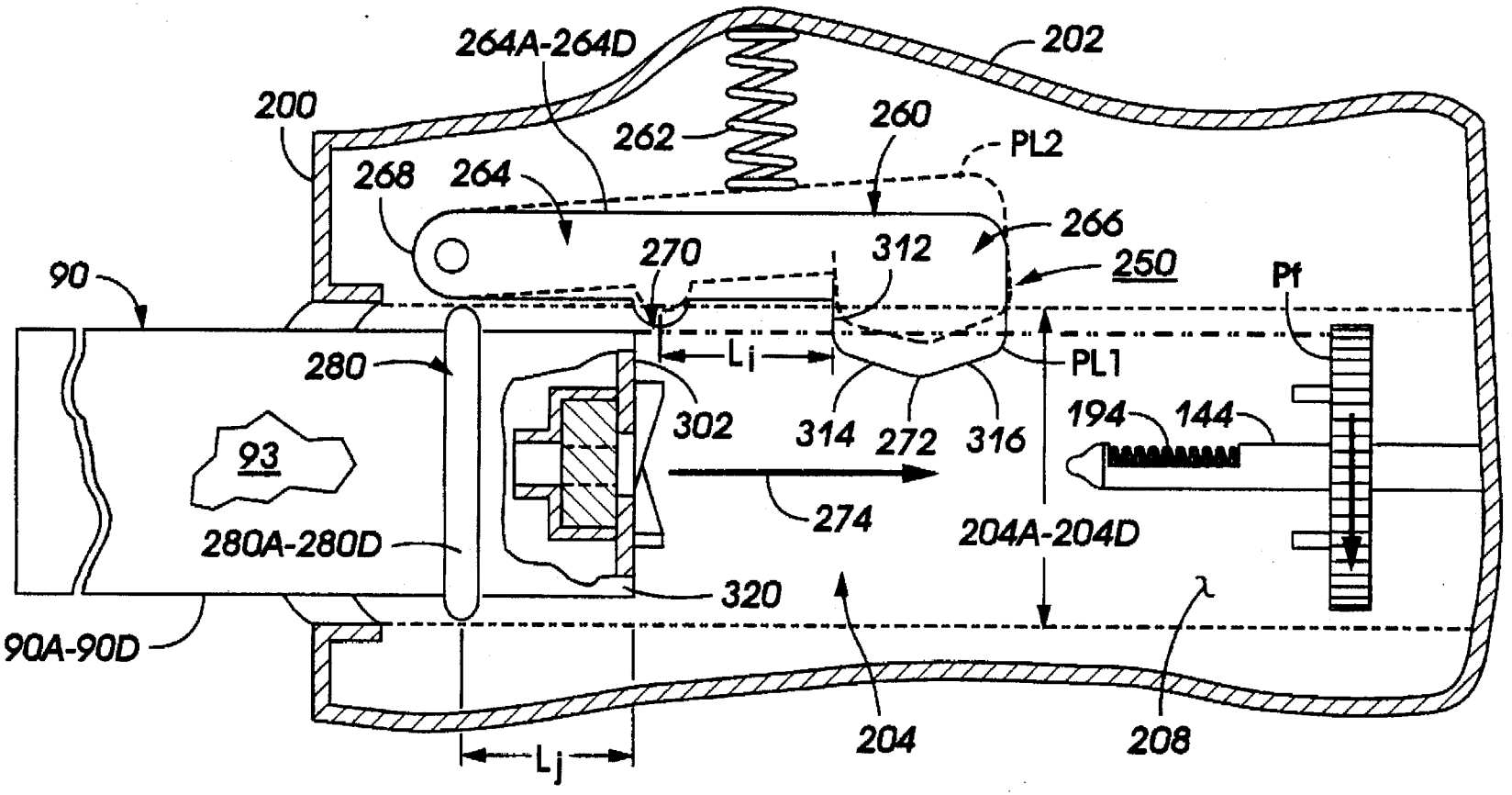
FIG. 2 is a schematic side view, partly in section, of a cartridge opening into the machine of FIG. 1, showing, in general, the orientation-independent cartridge discriminating system assembly of the present invention.

Referring now to FIGS. 1 and 2, an outside front portion 206 of the development station area of a hard copy document production machine 8 is illustrated, and incorporates the orientation-independent container or cartridge discriminating system assembly of the present invention. As illustrated, the system assembly of the present invention includes the machine frame 200 and a defining portion 202 of the machine frame defining, in general, a cartridge opening 204 for removably receiving a cartridge 90 containing a document production consumable material, such as different color toners. Although different color toners are described here as the document production consumable material, it is understood that such a consumable material equally can be developer material, copy paper, staples, or fusing oil, for example, provided in a customer replaceable container or cartridge for removably inserting into a cartridge opening such as 204 in the document production machine.

Still referring to FIGS. 1 and 2, each cartridge opening 204 has (i) a distal end 208 within the defining portion 202; (ii) an insertion distance measured from an outer surface of the opening into the opening, and (iii) a cartridge operating position Pf located at the distal end 208, for a cartridge 90 correctly inserted into the cartridge opening. The system assembly of the present invention also includes an orientation-independent cartridge type discriminating means 250 for enabling non-burdensome orientation-independent loading of a correct cartridge 90 into the cartridge opening 204, as well as, for resiliently intercepting and preventing the inadvertent attempted loading of an incorrect type specific cartridge 90A–90D into a cartridge type specific opening 204A–204D.

The orientation-independent cartridge discriminating means 250 includes a resilient assembly 260 mounted to the defining portion 202 of the machine frame for cooperatingly regulating the insertion and removal of a cartridge from the cartridge opening. The resilient assembly 260 is mounted to the defining portion 202 preferably at a position upstream of the cartridge operating position Pf, relative to a direction 274 of cartridge insertion. As illustrated, the resilient assembly 260 includes a first spring member 262, and a pivotable elongate member 264 that is connected to the spring member. The elongate member 264 has a first end 266 and a second end 268, a displaceable portion 270, and a cartridge blocking portion 272 towards the first end 266. The cartridge blocking portion 272 is located on the elongate member 264 spaced from the displaceable portion 270.

Importantly, in accordance with the present invention, the displaceable portion 270 as such has a cartridge-type first specific distance Li (i=A, B, C, D) measured on the elongate member from the cartridge blocking portion 272. The elongate member 264 thus is provided in cartridge type specific versions 264A, 264B, 264C, 264D (264A–264D) to correspond to the different cartridge types 90A–90B. Accordingly, a cartridge opening 204 becomes cartridge specific 204A, 204B, 204C, 204D (204A–204D) with the installation therein of a particular cartridge type specific elongate member 264A–264D. Each cartridge type specific opening 204A, 204B, 204C, 204D has a resilient assembly 260 mounted therein that includes a particular elongate member 264A–264D having a first distance Li that is specific for that cartridge opening and for a particular type of cartridge. Different cartridge openings thus have elongate members, each with a different and unique first distance Li.

Within each cartridge opening 204A–204D, the cartridge blocking portion 272 of the elongate member thereof, FIG. 2, has a first normal position PL1 where it overlaps into the cartridge opening itself, and a second position PL2 (shown in phantom) into which it can be displaced, and where its distal end is spaced from, and adjacent the cartridge opening 204.

Figure 3:
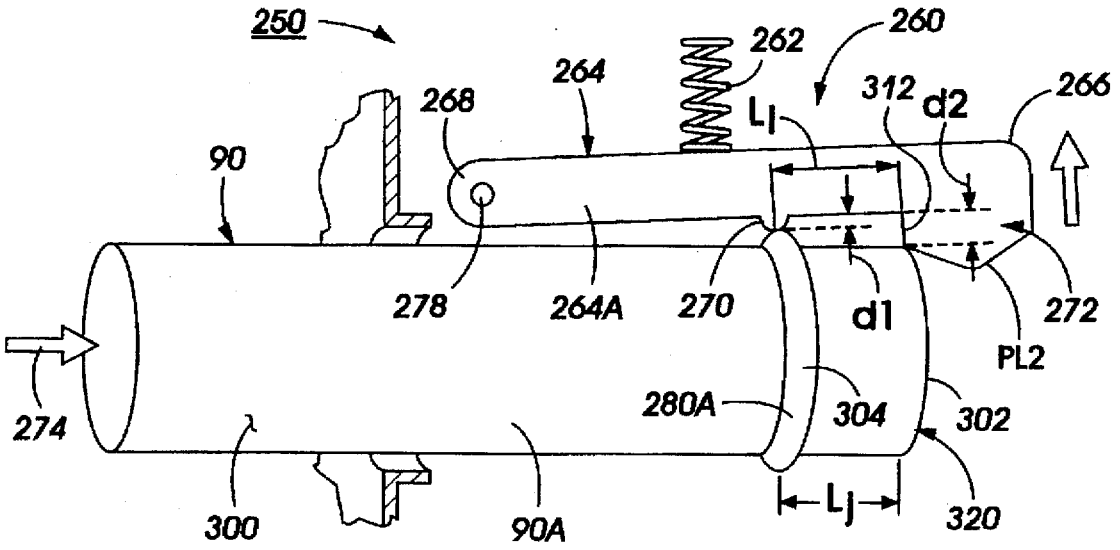
FIG. 3 is a schematic illustration of a correct type of cartridge successfully being inserted passed the blocking portion of the resilient assembly of a first embodiment of the system assembly of the present invention.
Figure 4:
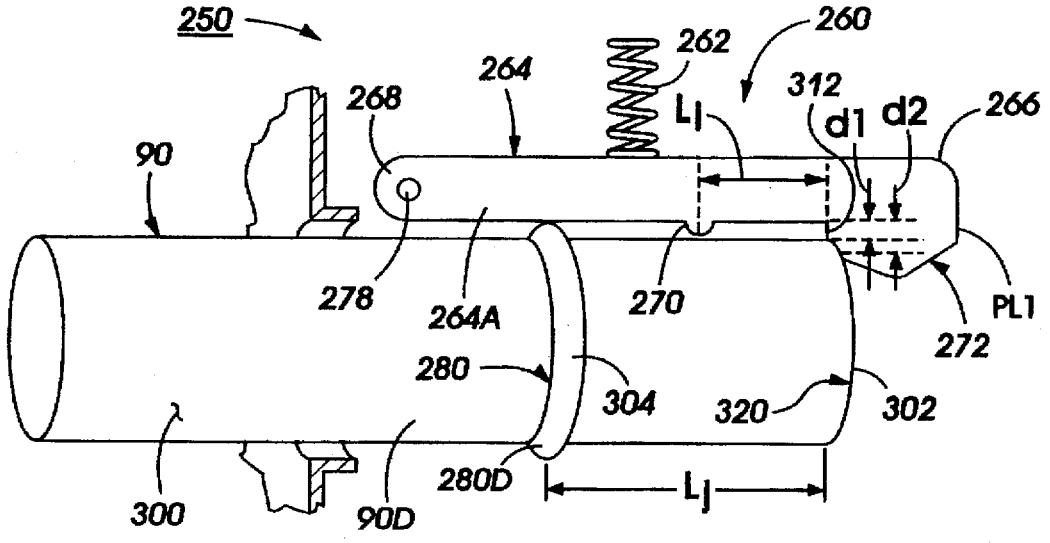
FIG. 4 is a schematic illustration of an incorrect or wrong type of cartridge being intercepted and prevented by the blocking portion of FIG. 3 from being inserted passed the blocking portion.

Referring to FIGS. 3 and 4, for example (but also true of all the other versions and FIGS.), the displaceable portion 270 of the elongate member 264 advantageously projects a first interference distance "d1" from a main body portion of the elongate member towards the cartridge opening 204. A distal end of the displaceable portion 270 is preferably radiused for enabling it to easily ride over a contoured surface of a displacer device. On the other hand, the blocking portion 272 has a blocking surface 312 projecting a second and greater interference distance "d2" from the main body portion towards the cartridge opening 204 for catching and preventing the inadvertent attempted insertion of a wrong cartridge, when in the first position PL1. As shown, the blocking surface 312 extends transversely to the direction 274 of cartridge insertion.

The blocking portion 272 as illustrated includes the blocking surface 312, and a first slanting surface 314 extending forwardly (relative to the direction of cartridge insertion) from a distal end of the blocking surface 312, and inwardly into the cartridge opening 204, so as to enable displaceable movement of the blocking portion from the first position PL1, to the second position PL2. The blocking portion 272 also includes a second slanting surface 316 extending rearwardly from a point spaced from the blocking surface 312, on the main body portion, and inwardly into the cartridge opening 204, to form an edge with the first slanting surface 314, for enabling easy removal of an inserted correct type cartridge from the cartridge opening 204.

The system assembly of the present invention further includes a displacer device 280 that is formed on the surface 300 of a cartridge 90 to be inserted into the cartridge opening. The displacer device 280 has a cartridge-type specific second distance Lj (j=A, B, C, D) that is measured from a lead edge 302 of each type of cartridge. The result is cartridges 90A–90D correspondingly having displacer devices 280A, 280B, 280C, 280D depending on the cartridge type specific second distance Lj thereof. The cartridge specific second distance Lj cooperates with the first cartridge specific distance Li of the elongate member 264A–264D within a cartridge opening 204A–204D, to determine whether or not a cartridge 90A–90D being inserted is a correct or wrong cartridge for the particular opening. The cartridge being inserted is the correct cartridge when the cartridge-type specific second distance Lj of the displacer device is equal to the cartridge-type specific first distance Li of the blocking member.

Importantly in accordance with the present invention, in order to make the operation of the system, orientation-independent and less burdensome, as well as, contamination risk-free, the cartridge 90 is preferably generally cylindrical as shown, or some other symmetrical shape about an axis thereof for potential variable orientation insertion. In addition, each displacer device 280A–280D is formed on the appropriate cartridge 90A–90D such that it extends continuously and uniformly on the surface 300 of the appropriate cartridge type, and in a direction that is transverse to the direction 274 of cartridge insertion, thus enabling non-burdensome orientation-independent loading or attempted loading of a cartridge 90A–90D into a cartridge opening 204A–204D. Further, in order to make the system assembly of the present invention contamination risk-free, the first spring member 262 of the resilient assembly 260 as shown, is a compressible spring having an uncompressed length and a compressed length. The first spring member 262 is mounted to the defining portion 202 so that it normally has its uncompressed and free length for locating the blocking portion 272 of the elongate member 264 within the first position PL1 thereof, and can temporarily assume its compressed length when moved into its second position PL2.

Referring now to FIGS. 3 to 10, various versions of the resilient assembly 260 of the system assembly of the present invention are illustrated. In each of the versions, only cartridge types 90A, and 90D (correct and incorrect types) are illustrated for a cartridge opening (204A not shown) suitable for receiving cartridge type 90A. Accordingly, cartridges with displacer devices 280B, 280C are not shown, but are typical. In one version of the resilient assembly 260, FIGS. 3, 4, and 9, 10, the first spring member 262 and the elongate member 264 thereof are mounted to the defining portion 202 (FIG. 2) of the machine frame, such that the first end 266 of the elongate member is positioned towards the distal end 208 of the cartridge opening 204 (FIG. 2). The elongate member 264 is pivotably mounted at the second end 268 thereof to the defining portion 202, and the first spring member 262 is connected to the elongate member at a point adjacent the second end 268.

Figure 5:
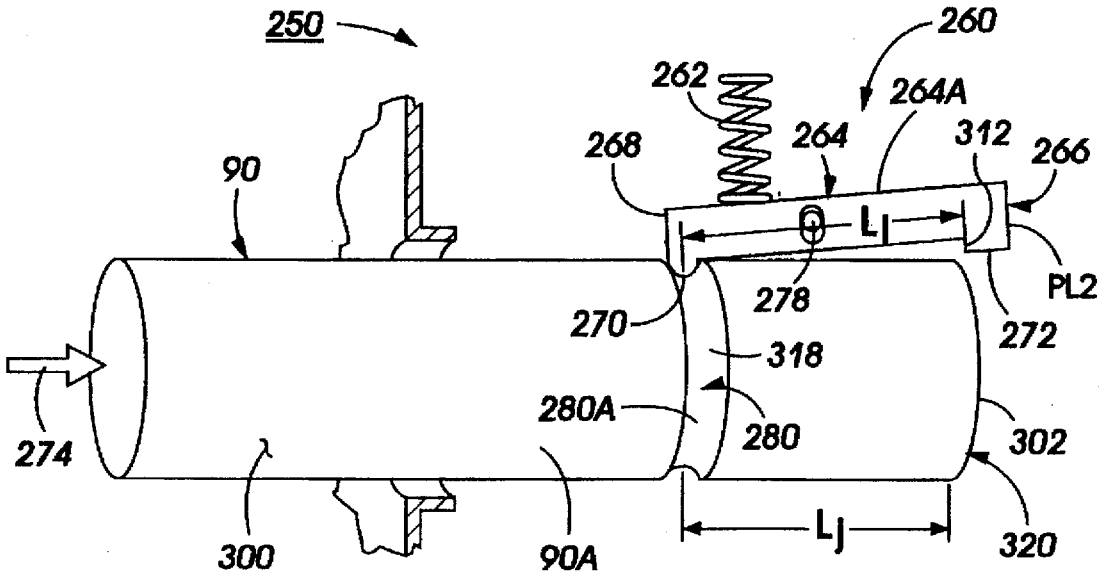
FIG. 5 is a schematic illustration of a correct type of cartridge successfully being inserted passed the blocking portion of the resilient assembly of a second embodiment of the system assembly of the present invention.
Figure 6:
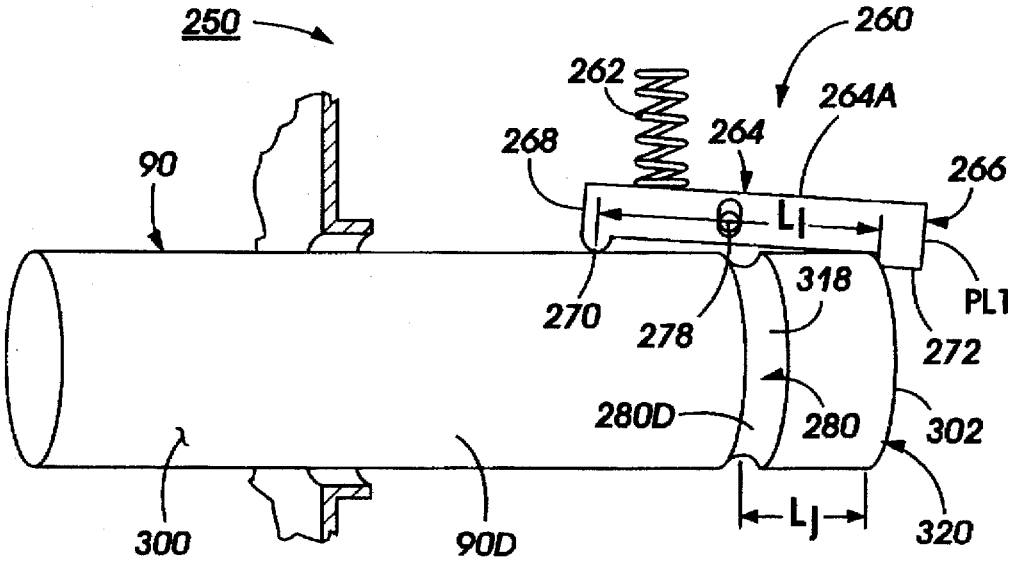
FIG. 6 is a schematic illustration of an incorrect or wrong type of cartridge being intercepted and prevented by the blocking portion of FIG. 5 from being inserted passed the blocking portion.

In another version, FIGS. 5 and 6, the elongate member 264 is pivotably mounted to the defining portion 202 at a pivot point 278 approximately midpoint between the first end 266 (including the blocking portion 272) and the second end 268 thereof. The first spring member 262 as shown is connected to the elongate member at a point adjacent the second end 268 thereof, and upstream of the pivot point 278 between the second end and the first end.

Figure 7:
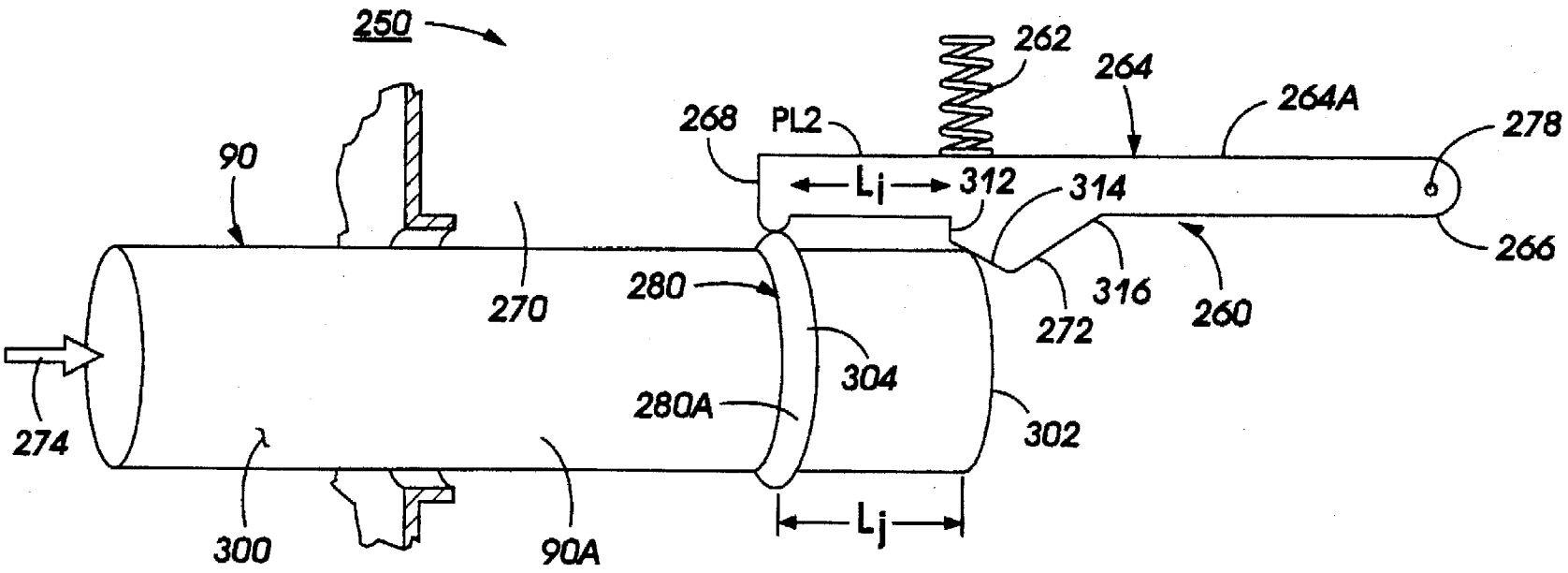
FIG. 7 is a schematic illustration of a correct type of cartridge successfully being inserted passed the blocking portion of the resilient assembly of a third embodiment of the system assembly of the present invention.
Figure 8:
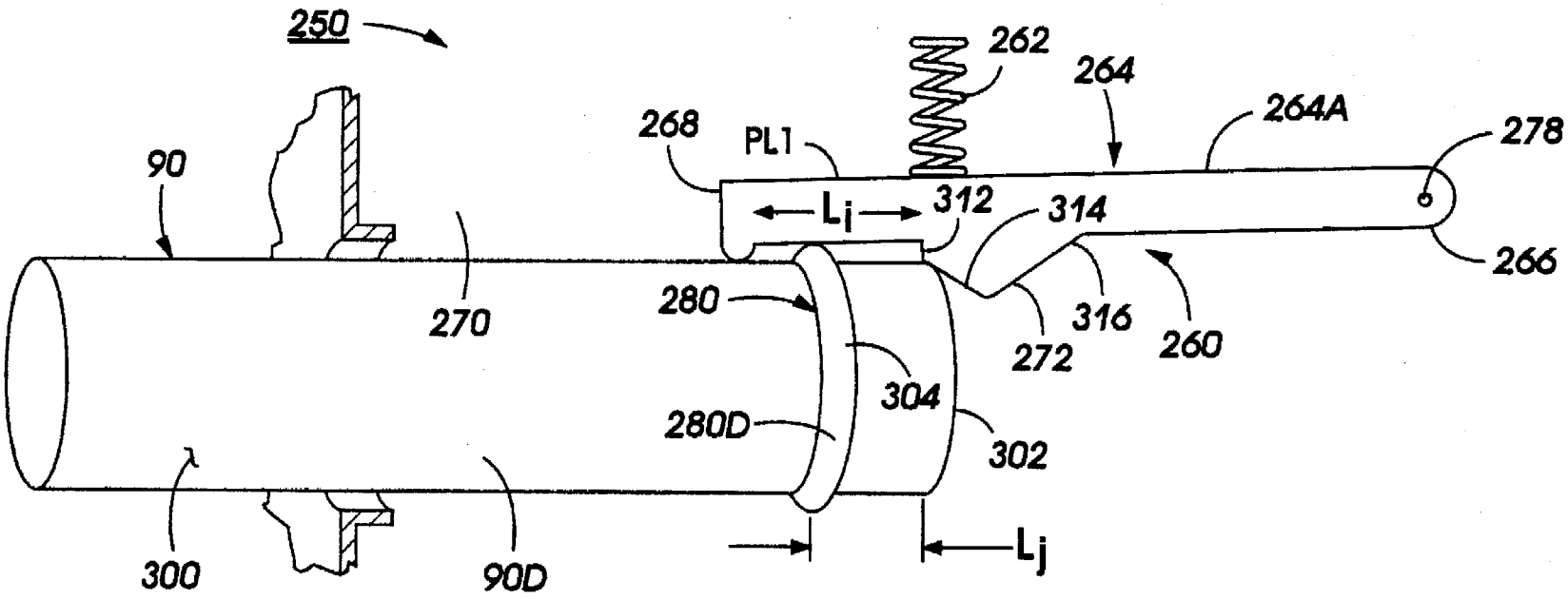
FIG. 8 is a schematic illustration of an incorrect or wrong type of cartridge being intercepted and prevented by the blocking portion of FIG. 7 from being inserted passed the blocking portion.

As shown, in yet another version of the resilient assembly 260, FIGS. 7 and 8, the spring member 262 and the elongate member 264 thereof are mounted to the defining portion 202 of the machine frame, such that the second end 268 of the elongate member instead is positioned towards the distal end 208 of the cartridge opening 204 (FIG. 2). The elongate member 264 is pivotably mounted at the second end 268 thereof to the defining portion 202 (FIG. 2). In this version, the first spring member 262 is connected to a point adjacent the first end 266 of the elongate member 264. Operation of the system assembly using this version of the resilient assembly thereof will be described below.

Figure 9:
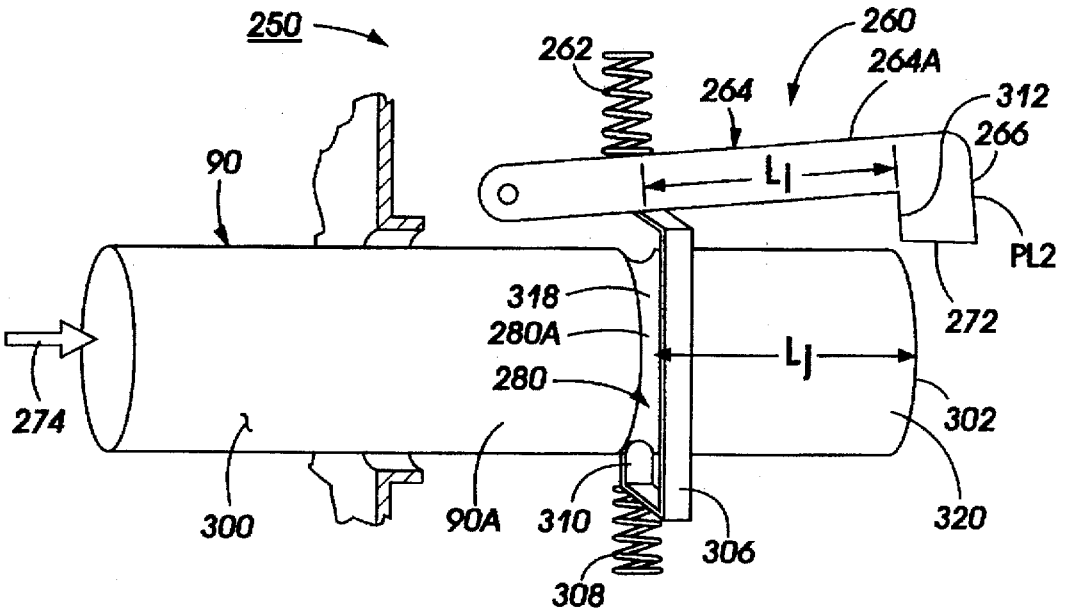
FIG. 9 is a schematic illustration of a correct type of cartridge successfully being inserted passed the blocking portion of the resilient assembly of a fourth embodiment of the system assembly of the present invention.
Figure 10:
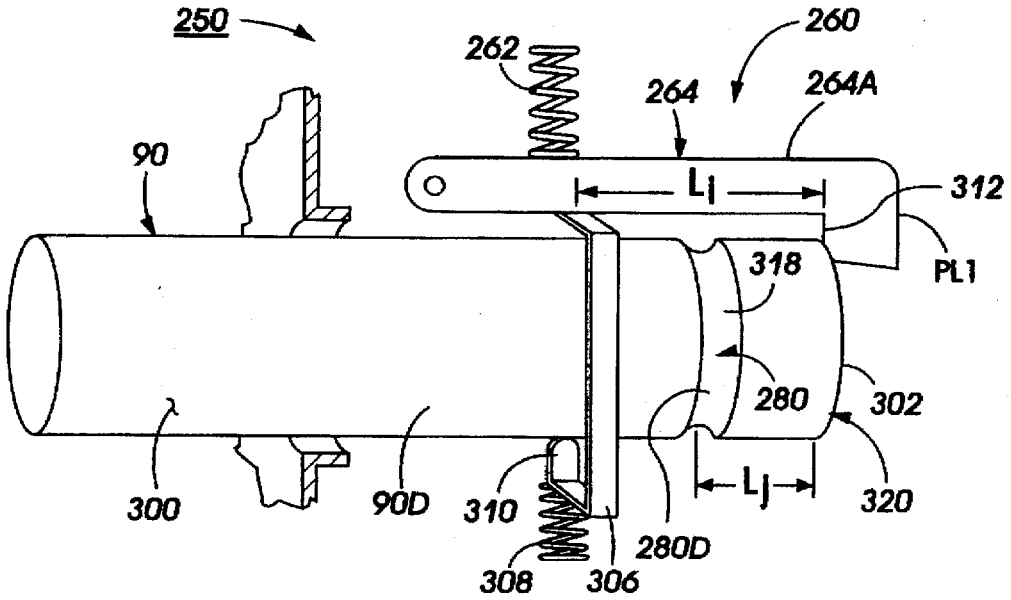
FIG. 10 is a schematic illustration of an incorrect or wrong type of cartridge being intercepted and prevented by the blocking portion of FIG. 9 from being inserted passed the blocking portion.

Referring now to FIGS. 9 and 10, the resilient assembly 260 can further include a movable bracket 306 positioned into contact with the elongate member 264, as well as, a second spring member 308 mounted to the defining portion 202 (FIG. 2) and to a point on the movable bracket 306 so as to be located oppositely from the first spring member 262. The movable bracket 306 includes a displaceable finger portion 310 for cooperating with the displacer device 280 on a correct cartridge being inserted into a cartridge opening (a cartridge opening including this version of the resilient assembly 260) to move the blocking portion 272 of the elongate member, from the first position PL1, to the second position PL2.

In the system assembly of the present invention, the displacer device 280 as formed on the surface 300 of a cartridge 90 may consist for example of a protuberance 304. Preferably, the protuberance 304 has a maximum projection height from the surface 300 that is greater than a difference between the first projection distance "d1" (FIGS. 3 and 4) of the displaceable portion 270 (of the elongate member 264) into the cartridge opening 204, and the second projection distance "d2" of the blocking portion 272 into the cartridge opening 204 (FIG. 2). The protuberance 304 preferably has a radiused inclining surface adjoining a radiused declining surface, relative to the direction of cartridge insertion, so as to enable easy riding movement of the radiused distal end of the displaceable portion 270 thereover.

Alternatively, the displacer device 280 as formed on the surface 300 of a cartridge 90 may consist for example of a recess 318 that is formed into the surface 300 of a cartridge. The recess 318 advantageously has a radiused surface and a maximum recess depth, from the surface of the cartridge, that is greater than a difference between the first projection distance "d1" (FIGS. 3 and 4) of the displaceable portion 270 (of the elongate member 264) into the cartridge opening 204, and the second projection distance "d2" of the blocking portion into the cartridge opening 204.

Referring now to FIGS. 1 and 2, each toner container or cartridge 90A–90D is removably insertable into a cartridge type specific receiving opening 204A–204D defined in the machine. The cartridge 90A–90D is insertable thus by pushing a lead end 320 of the cartridge in the direction 274 of cartridge insertion. When the cartridge being inserted is a correct cartridge for the particular cartridge opening, it eventually will connect to an auger tube 144 containing a toner removing auger 194. The toner removing auger 194 punctures a seal (not shown) into the chamber 93 of the cartridge, and operates to feed toner from the cartridge to the developer housing. Such a toner replenishment system using a cylindrical, insertable cartridge is disclosed, for example, in commonly assigned U.S. Pat. No. 5,495,323, herein incorporated by reference.

Referring to FIGS. 2, 3, 5, and 7, operation of the various versions of the orientation-independent cartridge discriminating system assembly of the present invention are illustrated in cases where the correct cartridge type 90A–90D is being inserted into the correct cartridge opening 204A–204D. As shown in FIG. 2, the resilient assembly 260 is normally located such that the pivotable elongate member 264A–264D, and its blocking portion 272 are in the cartridge insertion preventing first position PL1. This is true for each of the versions of FIGS. 3, 5, and 7. Because the displacer device 280A–280D formed on each cartridge extends continuously and uniformly in the cross or transverse direction to the direction of cartridge insertion, there is advantageously no need for a blind, trial and error, burdensome key-to-keyway aligning effort during insertion of the cartridge. The system of the present invention will work successfully with a cartridge being introduced into the cartridge opening independently of its rotational orientation.

When the cartridge being inserted is a correct cartridge, e.g. 90A, the lead end 320 of the cartridge (having the lead edge 302 and a displacer device 280A that is formed a second cartridge specific distance Lj (j=A) from the lead edge 302), will first be pushed passed the displaceable portion 270 of the elongate member 264A. Continued pushing of the cartridge in the direction of cartridge insertion will cause the lead edge 302 to move a distance equal to Li (i=A) towards the blocking portion 272. As illustrated in FIGS. 3, 5, 7 and 9, because a cartridge is a correct type when the first distance Li is equal to the second distance Lj, the displacer device 280A will contact the displaceable portion 270 and cause it to ride over the displacer contoured surface, thereby pivotably moving the blocking portion 272 from its first position PL1 to its second position PL2, against a resilient force of the first spring member 262. Movement of the blocking portion 272 as such takes the blocking surface 312 out of the way of the lead edge 302 of the cartridge 90A, and allows the lead edge to be fully inserted to the operating position Pf (FIG. 2)within an opening 204A.

In each of the versions of FIGS. 3, 5, 7 and 9, a correct cartridge 90A is shown having been inserted far enough for the displacer device 280A thereof to engage and be riding over the displaceable portion 270 of the elongate member 264A. Due to the geometry of the system of the present invention, the first spring member 262 forces the blocking portion 272 and the elongate member to pivot around the pivot point 278, thus lifting the blocking portion 272 from its first position PL1 to its second position PL2. Continued insertion of the cartridge will cause the lead edge 302, and then the surface 300 of the cartridge 90A (FIG, 2) to ride under the forward slanting surface 314 of the blocking portion 272 until full insertion of the cartridge is achieved. During removal of the cartridge 90A, the surface 300 and then the lead edge 302 will ride backwardly under the backward slanting surface 316, and under the blocking portion 272 as a whole, until the blocking portion 272 is returned by the spring member 262 to its first position PL1.

Referring now to FIGS. 4, 6, 8 and 10, the cartridge insertion prevention effect of the discriminating system assembly of the present invention is illustrated in cases of inadvertent attempted cartridge insertion of an incorrect or wrong cartridge 90D into an opening 204A (FIG. 2), for example. As illustrated, the lead end 320 of the cartridge 90D (having the lead edge 302 and a displacer device 280D formed thereon at a second cartridge specific distance Lj (j=D) from the lead edge), will first be pushed passed the displaceable portion 270 of the elongate member 264A. However, because the first cartridge specific distance Li (i=A) is not equal to the second distance Lj (j=D), the blocking surface 312 of blocking portion 272 will reach and catch or hook against the lead edge 302, before the displaceable portion 270 and displacer device 280D cooperate to pivot the blocking portion 272, from position PL1 to position PL2, and hence out of the way.

As shown clearly in FIGS. 4, 6, 8 and 10, the second cartridge-type specific distance Lj (j=D) is different from the first cartridge-type specific distance Li (i=A). As such, the geometry causes the blocking portion 272 to fail to rotate about the pivot point 278 as the first spring member 262 forces it to pivot around the displaceable portion 270. This results in the blocking portion being left in the first position PL1, and in a prevention position against cartridge 90D insertion.

It is, therefore, apparent that there has been provided in accordance with the present invention, an orientation-independent cartridge discrimination system assembly that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A hard copy document production machine system comprising:

(a) a machine frame;

(b) a defining portion of said machine frame defining (i) a cartridge opening for removably receiving a cartridge containing a document production consumable material, said cartridge opening having a distal end within said defining portion; (ii) an insertion distance from an outer surface of said opening into said opening, and (iii) a cartridge operating position located at said distal end, for a cartridge correctly inserted into said cartridge opening; and (c) an orientation-independent cartridge type discriminating system assembly for enabling non-burdensome orientation-independent loading of a correct cartridge into said cartridge opening, as well as, for resiliently intercepting and preventing loading of an incorrect cartridge into said cartridge opening, said discriminating system assembly including:

(i) a resilient assembly mounted to said defining portion of said machine frame, said resilient assembly including a first spring member and a pivotable elongate member connected to said spring member, and having a first and a second end, a displaceable portion, and a cartridge blocking portion spaced in the direction of cartridge insertion from said displaceable portion, said displaceable portion having a cartridge-type first specific distance from said cartridge blocking portion, and said cartridge blocking portion having a first position within said cartridge opening, and a second position adjacent said cartridge opening; and (ii) a displacer device formed on a surface of a cartridge being inserted into said cartridge opening, said displacer device having a cartridge-type specific second distance from a lead edge of a cartridge of the type of cartridge being inserted into said cartridge opening, said cartridge-type specific second distance determining a correct cartridge when equal to said cartridge-type specific first distance, and said displacer device extending continuously and uniformly on the surface of the cartridge and in a direction transverse to a direction of cartridge insertion, so as to enable non-burdensome orientation-independent loading of a cartridge.

2. In a hard copy document production machine using a plurality of different type cartridges containing different document production consumable materials, an orientation-independent cartridge type discriminating system assembly for enabling non-burdensome orientation-independent loading of a correct cartridge into a cartridge opening in the machine, and for resiliently intercepting and preventing loading of an incorrect cartridge into the cartridge opening, the discriminating system assembly comprising:

(a) a resilient assembly mounted to a defining portion of the frame of the machine defining the cartridge opening, said resilient assembly including a first spring member, and a pivotable elongate member connected to said spring member for providing cartridge contact upon cartridge insertion, said elongate member having a first and a second end, a displaceable portion, and a cartridge blocking portion spaced from said displaceable portion in a direction of cartridge insertion, said displaceable portion having a cartridge-type first specific distance from said cartridge blocking portion, and said cartridge blocking portion having a first position within the cartridge opening, and a second position adjacent the cartridge opening; and (b) a displacer device formed on a surface of a cartridge being inserted into the cartridge opening, said displacer device having a cartridge-type specific second distance from a lead edge of a cartridge being inserted into the cartridge opening, said cartridge-type specific second distance determining a correct cartridge when equal to said cartridge-type specific first distance, and said displacer device extending continuously and uniformly in a direction transverse to the direction of cartridge insertion, so as to enable non-burdensome orientation-independent loading of a cartridge into the cartridge opening.

3. The cartridge type discriminating system assembly of claim 2, wherein said resilient assembly is mounted to the defining portion of the machine frame at a position upstream of a cartridge operating position, relative to a direction of cartridge insertion.

4. The cartridge type discriminating system assembly of claim 2, wherein said first spring member of said resilient assembly is a compressible spring having an uncompressed length and a compressed length for resiliently intercepting and preventing loading of an incorrect cartridge into the cartridge opening.

5. The cartridge type discriminating system assembly of claim 4, wherein said first spring member is mounted to the defining portion of the machine and has said uncompressed length for locating said blocking portion of said elongate member in said first position thereof within the cartridge opening.

6. The cartridge type discriminating system assembly of claim 2, wherein said first spring member is mounted to the defining portion of the machine frame such that said second end of said elongate member is positioned towards a distal end of the cartridge opening, and said elongate member is mounted pivotably at said second end to the defining portion of the machine frame.

7. The cartridge type discriminating system assembly of claim 6, wherein said first spring member is connected to said first end of said elongate member.

8. The cartridge type discriminating system assembly of claim 2, wherein said first spring member is mounted to the defining portion of the machine frame such that said first end of said elongate member is positioned towards the distal end of the cartridge opening, and said elongate member is mounted pivotably at said second end to the defining portion of the machine frame.

9. The cartridge type discriminating system assembly of claim 8, wherein said first spring member is connected to a point between said first end and said second end of said elongate member.

10. The cartridge type discriminating system assembly of claim 2, wherein said first spring member is mounted to the defining portion of the machine frame, said first end of said elongate member is positioned towards the distal end of the cartridge opening, and said elongate member is mounted pivotably to the defining portion of the machine frame, at a pivot between said second end and said first end thereof.

11. The cartridge type discriminating system assembly of claim 10, wherein said first spring member is connected to a point upstream of the pivot point between said second end and said first end.

12. The cartridge type discriminating system assembly of claim 2, wherein said resilient assembly further includes a movable bracket positioned into contact with said elongate member, and a second spring member mounted to the defining portion of the machine frame and to a point on said movable bracket, and acts oppositely to said first spring member.

13. The cartridge type discriminating system assembly of claim 12, wherein said movable bracket includes a displaceable finger portion for cooperating with said displacer device on a correct cartridge being inserted to move said blocking portion of said elongate member from said first position to said second position thereof.

14. The cartridge type discriminating system assembly of claim 2, wherein said displaceable portion of said elongate member projects a first interference distance from a main body portion of said elongate member towards the cartridge opening, and said cartridge blocking portion has a blocking surface projecting a second and greater interference distance from the main body portion towards the cartridge opening.

15. The cartridge type discriminating system assembly of claim 14, wherein a distal end of said displaceable portion is radiused for easily riding over a contoured surface.

16. The cartridge type discriminating system assembly of claim 14, wherein said blocking surface extends transversely to the direction of cartridge insertion.

17. The cartridge type discriminating system assembly of claim 14, wherein said blocking member includes a first slanting surface extending forwardly from a distal end of said blocking surface, and inwardly into said cartridge opening for enabling displaceable movement of said blocking portion from said first position into said second position.

18. The cartridge type discriminating system assembly of claim 17, wherein said blocking member includes a second slanting surface extending rearwardly from a point on the main body portion spaced from said blocking surface, and inwardly into said cartridge opening to form an edge with said first slanting surface for enabling easy removal of an inserted correct type cartridge from said cartridge opening.

19. The cartridge type discriminating system assembly of claim 2, wherein said displacer device consists of a protuberance formed on the surface of the cartridge and having a maximum projection height from the surface of the cartridge, said maximum projection distance being greater than a difference between a first projection distance of said displaceable portion of said elongate member towards the cartridge opening, and a second and greater projection distance of said blocking surface towards the cartridge opening.

20. The cartridge type discriminating system assembly of claim 19, wherein said protuberance has a radiused inclining adjoining a radiused declining surface relative to the direction of cartridge insertion.

21. The cartridge type discriminating system assembly of claim 2, wherein said displacer device consists of a recess formed into the surface of the cartridge, said recess having a radiused surface and a maximum recess depth from the surface of the cartridge, said maximum recess depth being greater than a difference between a first projection distance of said displaceable portion of said elongate member towards the cartridge opening, and a second and greater projection distance of said blocking surface towards the cartridge opening.

* * * * *